US005968696A

United States Patent [19]

Yoshida et al.

[11] Patent Number: 5,968,696

[45] Date of Patent: Oct. 19, 1999

[54] ELECTROPHOTOGRAPHIC PHOTORECEPTOR

[75] Inventors: Ichiro Yoshida; Shozo Kaieda, both of Tokyo, Japan

[73] Assignee: FIT Corporation, Tokyo, Japan

[21] Appl. No.: 09/143,721

[22] Filed: Aug. 30, 1998

[51] Int. Cl.[6] ..... G03G 5/06

[52] U.S. Cl. ..... 430/78; 430/96

[58] Field of Search ..... 430/78, 96

[56] References Cited

U.S. PATENT DOCUMENTS

| | | | |
|---|---|---|---|
| 4,963,453 | 10/1990 | Kinoshita | 430/96 |
| 5,443,935 | 8/1995 | Kojima et al. | 430/78 |
| 5,686,216 | 11/1997 | Kubo et al. | 430/78 |
| 5,786,119 | 7/1998 | Sorriero et al. | 430/96 |

FOREIGN PATENT DOCUMENTS

| | | | |
|---|---|---|---|
| 0 473 800 A1 | 9/1990 | European Pat. Off. | G03G 5/06 |
| 0 430 630 A3 | 11/1990 | European Pat. Off. | G03G 5/06 |
| 0 569 943 A1 | 5/1993 | European Pat. Off. | G03G 5/06 |
| 0 738 933 A1 | 1/1996 | European Pat. Off. | G03G 5/06 |
| 63-210943 | 1/1988 | Japan | 430/96 |
| 1-142659 | 6/1989 | Japan | 430/96 |

*Primary Examiner*—Roland Martin
*Attorney, Agent, or Firm*—Lee & Fishman, L.L.P.; Daniel N. Fishman

[57] ABSTRACT

A single-layer binder comprising a synthetic resin binder and a phthalocyanine pigment dispersed therein is modified so as to reduce the content of the phthalocyanine pigment while maintaining or further improving the sensitivity of the binder. A coating material comprising a synthetic resin binder comprising as a constituent component a polyester resin containing halogen atoms, e.g., chlorine or bromine, and a phthalocyanine pigment dispersed in the binder is applied to a conductive base to produce an electrophotographic binder.

15 Claims, No Drawings

ELECTROPHOTOGRAPHIC PHOTORECEPTOR

BACKGROUND OF THE INVENTION

1. Field of the Invention

This invention relates to an electrophotographic photoreceptor. More particularly, it relates to a photoreceptor applicable to LED printers, digital copiers and digital image output apparatus such as laser printers.

2. Description of Related Art

The Carlson-type electrophotography utilized in printers or copiers (hard copy imaging systems) is based on a combination of a photoreceptor having photoconductivity and a technique of electrostatic charging. A surface of the photoconductive photoreceptor is evenly charged in the dark by means of a corona charging or similar device and is then irradiated with optical information, whereby the static charge is removed from the parts corresponding to the light image to form an electrostatic latent image corresponding to the light image. The latent image is developed with a colored charged powder to visualize the latent image.

The basic properties of a photoreceptor for use in electrophotography include the ability to be charged in the dark to an appropriate potential, the ability to retain the charged state for a given period, and the ability to enable the charges to be rapidly neutralized upon light irradiation.

Inorganic compounds such as amorphous silicon, amorphous selenium, cadmium sulfide, and zinc oxide have conventionally been used widely as preferred photoconductive materials for such electrophotographic photoreceptors.

None of these materials has proven to be adequate. Amorphous selenium and cadmium sulfide are harmful to the human body, have been designated as pollutants and have been prohibited from use in the future. Amorphous silicon has a high production cost because it is produced by a special vapor deposition technique.

Recently, investigations on organic photoreceptors as substitutes for inorganic photoreceptors have been made. Various compounds for use as organic photoreceptors have been proposed. Among these are phthalocyanine pigments, which have come to be used in photoreceptors for laser printers and related devices because of their sensitivity to light having long wavelengths.

However, the organic photoreceptors currently used in the market have various drawbacks. They are fabricated as two-layer photoreceptors composed of a charge-generating layer and a charge-transporting layer. Since these multilayered photoreceptors are negatively charged in use, the corona charging device for negative electrification generates about ten times the ozone than that generated by a corona charging device for positive electrification. The excess ozone must be removed to meet the requirements of the Industrial Safety and Health Law. In addition, ozone attacks the photoreceptor surface to, causing a decrease in photoreceptor life.

In contrast to photoreceptors of the negative electrification type, single-layer photoreceptors are usable in a positively charged state. Because of this, many proposals have been made for the improvement of a photoreceptor containing a phthalocyanine pigment.

For the purpose of improving the printing durability of a photoreceptor, a mixture of an acrylic resin and a melamine resin was used in Japanese Patent Laid-Open No. 15250/1984 and 219752/1984. In Japanese Patent Laid-Open No. 207145/1985, a mixture of a polyester resin, a polycarbonate resin, and an acrylic resin was used as a binder in order to improve moisture resistance.

As a means for improving sensitivity, use of a mixture of poly-N-vinylcarbazole and a polyester resin as a binder was disclosed in Japanese Patent Laid-Open No. 185044/1982.

In Japanese Patent Laid-Open No.105550/1984, a specific phenolic resin was used for sensitivity improvement. Another technique for sensitivity improvement incorporates an electron-accepting substance into a photosensitive layer, as disclosed in Kitamura and Komon, "Denshi Shashin Gakkai-shi (Journal of The Soc. of Electrophotography)," 20 (2) 10 (1982) and Kitamura and Komon, "Denshi Shashin Gakkai-shi," 20 (3) 2 (1982). In Japanese Patent Laid-Open No. 187248/1988, a polyester resin and a melamine resin were used as a binder together with a modified phthalocyanine in order to improve durability.

The functions required of a photoreceptor for printers include high durability and high sensitivity. This durability is expressed in terms of the total number of prints that the photoreceptor can yield while retaining its printing function and an acceptable image quality. A photoreceptor is chemically deteriorated during image printing by the ozone generated by corona, and it suffers surface wear due to mechanical friction during development, cleaning and paper transfer. This causes scratch marks, resulting in reduced image quality. In addition, the thickness of the photosensitive layer decreases, causing a decrease in electrification potential and an increase in fogging. None of the conventional multilayered photoreceptors has a durability of 100,000 sheets or higher under these conditions.

On the other hand, wear resistance in conventional single-layer photoreceptors has been obtained by binder improvement. However, their sensitivity has still been insufficient in practical use. Although an essential requirement for a high-speed printer is that the photoreceptor combines high sensitivity with high durability, the attainment of the two properties with any conventional technique for photoreceptor production has not been achieved.

Prior art organic photoreceptors have been regarded as unsuitable for high-speed printers because of their insufficient durability. The inventor has investigated improvements of single-layer photoreceptors for many years. Attempts were made to improve the durability of a photoreceptor by heightening its surface hardness. As a result, the inventor succeeded in improving the surface hardness of a photoreceptor to 3H pencil hardness. With respect to durability, it was found that the photoreceptor surface had not developed scratches leading to a decrease in image quality even after a 300,000-sheet printing, However, a high-speed printer is required to exhibit not only durability, but also high sensitivity and attenuation of surface potential upon exposure to a small amount of light. A conventional technique for imparting high sensitivity to a single-layer photoreceptor has been to increase the proportion of its photoconductive pigment. For example, in a single-layer photoreceptor containing a phthalocyanine pigment, increasing the proportion of the phthalocyanine pigment improves photosensitivity but accelerates dark decay to the point that the surface becomes potentially unstable. In addition, the pigment dispersion has abnormal viscosity characteristics, causing coating troubles.

Therefore, with respect to achieving high sensitivity in a single-layer photoreceptor, it is necessary to find a method for maintaining sensitivity even when a phthalocyanine pigment is incorporated in a small proportion to obtain a high-sensitivity photoreceptor with a desirable balance of all properties. The inventor felt a need to develop a new synthetic resin for use as a binder for a phthalocyanine pigment, and investigated this subject.

SUMMARY OF THE INVENTION

This invention relates to a composition of a single-layer photoreceptor obtained by dispersing a phthalocyanine pigment into a synthetic resin binder and applying the dispersion to a conductive base. In particular, this invention is intended to optimize the composition of a polyester resin for use as a binder to improve the photosensitivity of the photoreceptor.

The sensitivity of a photoreceptor varies with the proportion of a phthalocyanine pigment dispersed in a synthetic resin binder. Some proportions may accelerate the dark decay of the photoreceptor to impair electrification stability. The proportion of a phthalocyanine pigment is an important determinant of photoreceptor properties. As the proportion of a phthalocyanine pigment increases, the sensitivity becomes higher but dark decay is accelerated simultaneously, causing trouble in practical use. In addition, the coating material displays highly thixotropic or other abnormal viscosity properties, and is apt to cause unevenness of the coating when applied to form a photosensitive layer.

A photosensitive layer in which a surface part has a composition containing a smaller proportion of a phthalocyanine pigment has higher mechanical surface strength. According to the inventor's experiences, when the content of a phthalocyanine pigment is higher than 20% by weight, troubles are apt to arise during photoreceptor production, and a weakened photoreceptor surface results. Where a photosensitive layer is formed to compensate for the above problems by using a binder content exceeding 80% by weight, the photoreceptor has reduced sensitivity and this must be compensated for.

An effective means for improving the sensitivity of a photoreceptor comprising a photosensitive layer containing a phthalocyanine pigment dispersed in a synthetic resin binder is to use a polyester resin containing, as a constituent component, a halogenated organic acid containing at least one halogen atom in the synthetic resin binder.

The synthetic resin binders usable in the photosensitive layer includes acrylic resin, polyester resin, styrene/butadiene copolymer resin, polycarbonate resin, vinyl chloride/vinyl acetate copolymer resin, polyurethane resin, epoxy resin, and polyvinyl butyral resin, though polyester resins are preferable. By mixing an amino resin as a crosslinking agent with a polyester resin, a photoreceptor can be obtained that has a higher mechanical strength and a higher surface hardness.

Improving the dispersibility of a pigment during photoreceptor production is an important factor in ensuring evenness of film thickness, evenness of electrification potential, and evenness of photosensitivity. The inventor attained optimization by using starting materials for a binder resin in combination with a starting material effective in dispersing pigments.

Phthalocyanine pigments suitable for this invention include copper phthalocyanines in $\alpha$, $\beta$, $\gamma$, $\delta$, $\epsilon$, and $\chi$ forms and metal-free phthalocyanines in $\alpha$, $\beta$, $\gamma$, $\delta$, $\epsilon$, and $\chi$ forms. Titanyl phthalocyanines in various crystal forms are also usable and effective.

Examples of dibasic saturated acids usable as starting materials for the polyester resin include phthalic anhydride, isophthalic acid, terephthalic acid, tetrahydrophthalic anhydride, hexahydrophthalic anhydride, and endomethylenetetrahydrophthalic anhydride. Examples of dibasic unsaturated acids usable as the starting materials include maleic anhydride and fumaric acid.

Usable halogenated saturated acids are limited in kind. Examples thereof include tetrachlorophthalic anhydride, tetrabromophthalic anhydride, chlorendic anhydride, and an adduct of hexachlorocyclopentadiene with tetrahydrophthalic anhydride. Of these, chlorendic anhydride (also called HET acid) has a high chlorine content and high reactivity and is hence effective as a material for a polyester resin for use in this invention.

A usable glycol ingredient comprises a combination of neopentyl glycol as the main component with ethylene glycol, propylene glycol, diethylene glycol, dipropylene glycol, etc. Since use of neopentyl glycol in excess results in impaired solubility in organic solvents, a combination of neopentyl glycol with other glycol(s) is preferred.

For producing a polyester resin suitable for photoreceptor production, a mixture of a halogenated organic acid and one or more other dibasic organic acids is used, in which the proportion of the halogenated organic acid is preferably from 0.5 to 10% by mole. The halogen content of all the binders in the photosensitive layer is preferably from 1.0% to 10% by weight.

The appropriate range of the content of halogen atoms in the binder is narrow. If the content is too low, it is difficult to achieve sensitivity improvement. Although sensitivity heightens gradually with increasing halogen content, a halogen content exceeding the limits stated above results in accelerated dark decay in photoreceptor surface potential. If the halogen content is increased further, the potential decreases immediately after charging so that a given surface potential cannot be maintained. Since this photoreceptor has no practical use, it is necessary to incorporate halogen atoms in an amount within the appropriate range.

When a polyester resin synthesized from starting materials containing a halogenated organic acid was used as a binder for a phthalocyanine pigment in combination with an amino resin as a crosslinking agent in producing a photoreceptor, a photosensitive layer reduced in coating unevenness and having a low phthalocyanine pigment content was obtained from a coating material having appropriate viscosity during application. The photoreceptor produced had evenness of surface potential and improved photosensitivity suitable for practical use.

The photoreceptor having a low phthalocyanine pigment content and an acceptable sensitivity was mounted in a printer and subjected to an imaging test. The photoreceptor was found to have excellent half-tone reproducibility and to yield prints having high evenness of image density, a factor that is indispensable for the design of a printer capable of printing high-precision images. The organic photoreceptor discussed above can be useful in the future printer market. Moreover, since the photosensitive layer has an increased binder content, it has an increased surface hardness and is resistant to surface wear. As a result, the photoreceptor can have excellent durability.

DETAILED DESCRIPTION OF THE PREFERRED EMBODIMENTS

While the invention is susceptible to various modifications and alternative forms, a specific embodiment thereof has been shown by way of example described in detail herein below. It should be understood, however, that it is not intended to limit the invention to the particular form disclosed, but on the contrary, the invention is to cover all modifications, equivalents, and alternatives falling within the spirit and scope of the invention as defined by the appended claims.

This invention is explained below with reference to examples of production processes.

EXAMPLE 1

A method of synthesizing a binder is explained first. A 1-liter flask was charged with 114 parts (1.5 mol) of propylene glycol, 104 parts (1.0 mol) of neopentyl glycol, 355.2 parts (2.4 mol) of isophthalic acid, and 38.9 parts (0.1 mol) of HET acid. The contents were heated to 80 to 90° C. while introducing a small amount of nitrogen gas into the flask. Gentle stirring was initiated, and the temperature of the mixture was elevated to 150 to 160° C. over 1 to 1.5 hours. The mixture was further heated to 190° C. over 3 to 4 hours. After the mixture was maintained at 190° C. for 1 hour, it was kept from being further heated until the acid value of the resin ingredient had decreased to 50 or below, while removing unreacted starting materials at a reduced pressure.

When the acid value had reached a given value, the temperature was lowered and the resin was taken out of the flask. The resin was an amber fragile solid. It was powdered to an appropriate size to be used as a binder.

Ten parts of the synthesized polyester resin, 16.7 parts of a butylated melamine resin (U-Van 20SE60, manufactured by Mitsui Toatsu Chemicals, Inc.), 5 parts of a metal-free phthalocyanine (manufactured by Dainichi Seika Colour & Chemicals Mfg. Ltd.), and 0.2 part of an antioxidant (Irganox 565, manufactured by Ciba-Geigy Japan Ltd.) were introduced into a sand mill together with 100 parts of cyclohexanone. The mixture was kneaded for 2 hours. The resultant binder had a chlorine content of 1.7%.

The resulting solution had a viscosity of 400 mPa.s (20° C.), which was suitable for dip coating. The surface of an aluminum pipe was dip-coated with this solution and heated at 120° C. for 1 hour to dry the coating. The resultant photosensitive layer had a thickness of 18 m. The surface of the photosensitive layer was smooth, even and semiglossy. The layer had a surface hardness of 2H pencil hardness.

This photoreceptor was examined for electrophotographic properties. The photoreceptor surface was charged at a voltage of +600 V and fluctuations of its potential were measured while rotating the photoreceptor. The fluctuations were within 20 V, showing that the charged state was extremely stable. The photoreceptor had a sensitivity of 0.5 to 0.6 J/cm$^2$ in terms of half-decay exposure to 780-nm light. From these found values, the photoreceptor was judged to be capable of practical use.

EXAMPLE 2

A sand mill was charged with 27 parts of the polyester resin synthesized in Example 1, 10.7 parts of a butylated melamine resin (U-Van 20SE60, manufactured by Mitsui Toatsu Chemicals, Inc.), 5 parts of a metal-free phthalocyanine (manufactured by Dainichi Seika Colour & Chemicals Mfg. Ltd.), and 0.1 part of an antioxidant (Irganox 565, manufactured by Ciba-Geigy Japan Ltd.) together with 130 parts of cyclohexanone. The mixture was kneaded for 2 hours. The resultant binder had a chlorine content of 2.8%.

The resulting solution had a viscosity of 350 mpa.s (20° C.), which was suitable for dip coating. The surface of an aluminum pipe was dip-coated with this solution and heated at 120° C. for 1 hour to dry the coating. The resultant photosensitive layer had a thickness of 18 $\mu$m. The surface of the photosensitive layer was smooth, even, and glossier than that obtained in Example 1. The layer had a surface hardness of 3H pencil hardness.

This photoreceptor was examined for electrophotographic properties. The photoreceptor surface was charged at a voltage of +600 V and fluctuations of its potential to were measured while rotating the photoreceptor. The fluctuations were within 20 V, showing that the charged state was extremely stable. The photoreceptor had a sensitivity of 0.6 to 0.7 $\mu$J/cm$^2$ in terms of half-decay exposure to 780-nm light. From these found values, the photoreceptor was judged to be capable of practical use.

EXAMPLE 3

A 1-liter flask was charged with 159 parts (1.5 mol) of diethylene glycol, 104 parts (1.0 mol) of neopentyl glycol, 325.6 parts (2.2 mol) of isophthalic acid, and 139.1 parts (0.3 mol) of tetrabromophthalic anhydride. The contents were heated to 80 to 90° C. while introducing a small amount of nitrogen gas into the flask. Gentle stirring was initiated, and the temperature of the mixture was elevated to 150 to 160° C. over 1 to 1.5 hours. The mixture was further heated to 190° C. over 3 to 4 hours. After the mixture was maintained at 190° C. for 1 hour, it was further heated until the acid value of the resin ingredient decreased to 50 or below, while removing unreacted starting materials at a reduced pressure.

When the acid value had reached a given value, the temperature was lowered and the resin was taken out of the flask. The resin was a light-brown fragile solid. It was powdered to an appropriate size to be used as a binder.

Ten parts of the synthesized polyester resin, 16.7 parts of a butylated melamine resin (U-Van 20SE60, manufactured by Mitsui Toatsu Chemicals, Inc.), 4.8 parts of a metal-free phthalocyanine (manufactured by Dainichi Seika Colour & Chemicals Mfg. Ltd.), and 0.2 part of an antioxidant (Irganox 565, manufactured by Ciba-Geigy Japan Ltd.) were introduced into a sand mill together with 100 parts of cyclohexanone. The mixture was kneaded for 2 hours. The resultant binder had a bromine content of 1.6%.

The resulting solution had a viscosity of 380 mpa.s (20° C.), which was suitable for dip coating. The surface of an aluminum pipe was dip-coated with this solution and heated at 120° C. for 1 hour to dry the coating. The resultant photosensitive layer had a thickness of 18 $\mu$m. The surface of the photosensitive layer was smooth and even, and had a dull gloss.

This photoreceptor was examined for electrophotographic properties. The photoreceptor surface was charged at a voltage of +600 V and fluctuations of its potential were measured while rotating the photoreceptor. The fluctuations were within ±20 V, showing that the charged state was extremely stable. The photoreceptor had a sensitivity of 0.5 to 0.6 $\mu$J/cm$^2$ in terms of half-decay exposure to 780-nm light. From these found is values, the photoreceptor was judged to be capable of practical use.

Comparative Example

A photoreceptor was produced from the same composition as in Example 1, except that a polyester resin containing no halogen molecules was used. A sand mill was charged with 16.7 parts of the polyester resin (Almatex P645, manufactured by Mitsui Toatsu Chemicals, Inc.), 16.7 parts of a butylated melamine resin (U-Van 20SE60, manufactured by Mitsui Toatsu Chemicals, Inc.), 5 parts of a metal-free phthalocyanine (manufactured by Dainichi Seika Colour & Chemicals Mfg. Ltd.), and 0.2 part of an antioxidant (Irganox 565, manufactured by Ciba-Geigy Japan Ltd.) together with 90 parts of cyclohexanone. The mixture was kneaded for 2 hours.

The obtained solution had a viscosity of 450 mpa.s (20° C.), which was suitable for dip coating. The surface of an aluminum pipe was dip-coated with this solution and heated at 120° C. for 1 hour to dry the coating. The resultant photosensitive layer had a thickness of 18 $\mu$m. The surface of the photosensitive layer was smooth, even, and semi-glossy. The layer had a surface hardness of 2H pencil hardness.

This photoreceptor was examined for electrophotographic properties. The photoreceptor surface was charged at a voltage of +600 V and fluctuations of its potential were measured while rotating the photoreceptor. The fluctuations were within ±20 V, showing that the charged state was extremely stable. The photoreceptor had a sensitivity of 3.50 to 4.0 $\mu J/cm^2$ in terms of half-decay exposure to 780-nm light. From this sensitivity, it was judged that this photoreceptor had a sensitivity about one seventh the sensitivity of the photoreceptor prepared in Example 1. The photoreceptor of this Comparative Example was difficult to use in practical printers.

As described above, this invention is based on the finding that, in a single-layer photoreceptor containing a phthalocyanine pigment dispersed in a synthetic resin binder, the photoreceptor sensitivity is significantly improved by using a synthetic resin binder comprising a polyester resin containing halogen atoms, such as chlorine or bromine, as a constituent component. Due to this finding, the poorly dispersible phthalocyanine pigment can be used in a reduced amount and easily dispersed to achieve a stable dispersed state. Thus, coating unevenness and thickness unevenness, which are apt to occur during coating for photoreceptor production, can be diminished.

The photoreceptors produced in Examples 1, 2, and 3 were each mounted in a printer to conduct image evaluation as described above. As a result, it was found that the photoreceptors gave prints having excellent evenness of half-tone image density. They were superior in density gradation to commercial photoreceptors. The photoreceptors produced in the Examples were further evaluated for durability in a printing test. As a result, it was found that the photoreceptors had a life about 2 times that of commercial photoreceptors.

While the invention has been illustrated and described in detail in the foregoing description, such illustration and description is to be considered as exemplary and not restrictive in character, it being understood that only the preferred embodiment and minor variants thereof have been shown and described and that all changes and modifications that come within the spirit of the invention are desired to be protected.

What is claimed is:

1. A single-layer electrophotographic photoreceptor comprising:

a synthetic resin binder comprising a polyester resin and, as a constituent of said synthetic resin binder, a halogenated organic acid containing at least one halogen atom, and a phthalocyanine pigment dispersed in said synthetic resin binder.

2. The photoreceptor of claim 1 wherein the content of said halogenated organic acid in said synthetic resin binder ranges from about 0.5 molar percent to about 10 molar percent.

3. The photoreceptor of claim 1 wherein the content of halogen atoms in the synthetic resin binder ranges from about 1 percent by weight to about 10 percent by weight.

4. The photoreceptor of claim 1 wherein said halogenated organic acid is chosen from the group consisting of tetrachlorophthalic anhydride, tetrabromophthalic anhydride, chlorendic anhydride, and an adduct of hexachlorocyclopentadiene with tetrahydrophthalic anhydride.

5. The photoreceptor of claim 1 wherein said polyester resin is synthesized from one or more members of the group consisting of neopentyl glycol, ethylene glycol, propylene glycol, diethylene glycol, and dipropylene glycol.

6. The photoreceptor of claim 1 wherein said polyester resin is synthesized from neopentyl glycol and at least one other glycol selected from the group consisting of ethylene glycol, propylene glycol, diethylene glycol, and dipropylene glycol.

7. The photoreceptor of claim 1 wherein said synthetic resin binder comprises a dibasic organic acid as a constituent of said synthetic resin binder.

8. The photoreceptor of claim 7 wherein said dibasic organic acid is chosen from the group consisting of phthalic anhydride, isophthalic acid, terephthalic acid, tetrahydrophthalic anhydride, hexahydrophthalic anhydride, endomethylenetetrahydrophthalic anhydride, maleic anhydride and fumaric acid.

9. The photoreceptor of claim 7 wherein said dibasic organic acid is isophthalic acid.

10. The photoreceptor of claim 7 wherein the proportion of said halogenated organic acid in said synthetic resin binder to all said dibasic acids in said synthetic resin binder is from about 0.5% molar percent to about 10% molar percent.

11. The photoreceptor of claim 1 wherein said phthalocyanine pigment is chosen from the group consisting of copper phthalocyanines in $\alpha$, $\beta$, $\gamma$, $\delta$, $\epsilon$, and $\chi$ forms, metal-free phthalocyanines in $\alpha$, $\beta$, $\gamma$, $\delta$, $\epsilon$ and $\chi$ forms, and titanyl phthalocyanines.

12. The photoreceptor of claim 1 further comprising an amino resin as a crosslinking agent.

13. The photoreceptor of claim 12 wherein said amino resin is a butylated melamine resin.

14. A single-layer electrophotographic photoreceptor comprising:

a synthetic resin binder comprising a polyester resin and, as constituents of said polyester resin, chlorendic anhydride and isophthalic acid, and a metal-free phthalocyanine pigment dispersed in said synthetic resin binder.

15. A hard-copy imaging system comprising:

a single-layer electrophotographic photoreceptor having:

a synthetic resin binder comprising a polyester resin and, as constituents of said polyester resin, chlorendic anhydride and isophthalic acid, and a metal-free phthalocyanine pigment dispersed in said synthetic resin binder.

* * * * *